US007335040B2

(12) United States Patent
Ota et al.

(10) Patent No.: US 7,335,040 B2
(45) Date of Patent: Feb. 26, 2008

(54) ELECTROMAGNETIC RELAY

(75) Inventors: Yoshinori Ota, Miyagi (JP); Tatsumi Ide, Miyagi (JP)

(73) Assignee: NEC Tokin Corporation, Miyagi (JP)

( * ) Notice: Subject to any disclaimer, the term of this patent is extended or adjusted under 35 U.S.C. 154(b) by 0 days.

(21) Appl. No.: 11/538,651

(22) Filed: Oct. 4, 2006

(65) Prior Publication Data

US 2007/0087585 A1 Apr. 19, 2007

(30) Foreign Application Priority Data

Oct. 5, 2005 (JP) ..... 2005-292381

(51) Int. Cl.
*H01R 29/00* (2006.01)

(52) U.S. Cl. ..... 439/188; 335/78

(58) Field of Classification Search ..... 335/78, 335/128, 129, 130, 131, 83, 190
See application file for complete search history.

(56) References Cited

U.S. PATENT DOCUMENTS 5,160,910 A * 11/1992 Tsuji ..... 335/129
6,781,490 B2 * 8/2004 Funayama et al. ..... 335/78
2005/0190025 A1 * 9/2005 Yamamoto et al. ..... 335/128

FOREIGN PATENT DOCUMENTS

JP 4-319292 11/1992

* cited by examiner

*Primary Examiner*—James R. Harvey
*Assistant Examiner*—Travis Chambers
(74) *Attorney, Agent, or Firm*—Whitham Curtis Christofferson & Cook, P.C.

(57) ABSTRACT

An electromagnetic relay is provided which allows free design of arrangements of each external connecting terminal and is capable of effectively dissipating heat from a base and suppressing a rise in temperatures within the electromagnetic relay. The electro-magnetic relay includes a core, a coil, a yoke, an armature, an electromagnetic block made up of a movable spring having a movable contact mechanically coupled to the armature, a pair of fixed contacts made up of an ordinarily closed fixed contact and an ordinarily opened fixed contact both being contacted with the movable contact, a group of external connecting terminals, a base, and an armored cover, wherein the movable spring and the yoke make up part of a current-carrying path, and a yoke extended portion is in direct mechanical contact with the movable contact external connecting terminal and the ordinarily closed fixed contact is mechanically coupled to an ordinarily closed fixed contact external connecting terminal.

17 Claims, 3 Drawing Sheets

ELECTROMAGNETIC RELAY

BACKGROUND OF THE INVENTION

1. Field of the Invention

The present invention relates to an electromagnetic relay to be mounted on a printed circuit board or a like and more particularly to the electromagnetic relay to control the switching ON/OFF of a current as comparatively large as about several tens of amperes used in automotive electrical devices, household electrical appliances, or a like.

The present application claims priority of Japanese Patent Application No. 2005-292381 filed on Oct. 5, 2005, which is hereby incorporated by reference.

2. Description of the Related Art

An example of a conventional electromagnetic relay to switch conduction for control of a motor, a solenoid, or a like is disclosed in Patent Reference 1 (Japanese Utility Model Application No. Hei 03-86545) which includes an electromagnet made up of a coil, a core, and a yoke, an armature which is attracted by the electromagnet, a movable contact spring to make the armature exert its stability, a movable contact coupled to a tip of the movable contact spring, a fixed contact mounted in a place being opposite to the movable contact, a fixed contact terminal connected electrically to the fixed contact, and a movable contact terminal electrically to the movable contact. Some of the movable contact terminal has a configuration being integral with the movable contact spring as shown in FIG. 8 in the Patent Reference 1.

However, in the conventional electromagnetic relay that carries a current of several tens of amperes for control of a motor, a solenoid, or a like, a rise in temperatures occurs due to heat generated at a contact making up a current-carrying path, terminal, movable spring, or a like and due to heat transferred from the coil. In recent years, there appears a problem that, due to contradictory demands for miniaturization of a relay and for high-capacity (large current) operations of the relay, a rise in temperatures within the relay is inevitable which, as a result, causes operating failures. Therefore, the suppression in the rise in temperatures in the relay is required.

SUMMARY OF THE INVENTION

In view of the above, it is an object of the present invention to provide an electromagnetic relay which is capable of effectively dissipating heat from a base and of suppressing a rise in temperatures within the electro-magnetic relay.

According to a first aspect of the present invention, there is provided an electromagnetic relay including:

an electromagnetic block including a core, a coil, a yoke, an armature, and a movable spring having at least one movable contact mechanically coupled to the armature;

at least one fixed contact associated with the at least one movable contact;

a group of external connecting terminals including at least one movable contact external connecting terminal, at least one fixed contact external connecting terminal, and at least one coil external connecting terminal being electrically connected respectively to the at least one movable contact, the at least one fixed contact, and the coil;

a base on which the electromagnetic block, the at least one fixed contact, the group of external connecting terminals are mounted and secured; and an armored cover, wherein the movable spring, the armature, and the yoke make up part of a current-carrying path;

wherein the group of external connecting terminals is formed from a plate-shaped conductive material and part of each of the external connecting terminals is insert-molded into the base using an electrically insulating material;

wherein the at least one movable contact external connecting terminal is exposed from the base so as to come into contact with part of the yoke and the contacted portion of the at least one movable contact external connecting terminal is mechanically coupled and secured to part of the yoke; and wherein at least one the fixed contact is mechanically coupled to the at least one fixed contact external connecting terminal.

In the foregoing first aspect, a preferable mode is one wherein the group of external connecting terminals is formed from at least one piece of the plate-shaped conductive material by cutting and bending.

Also, a preferable mode is one wherein the electrically insulating material includes a resin or ceramic.

Also, a preferable mode is one wherein the at least one movable contact external connecting terminal is exposed from the base so as to come into direct mechanically contact with part of the yoke.

In addition, a preferable mode is one wherein the at least one fixed contact is mechanically coupled to the at least one fixed contact external connecting terminal by at least one of methods of fitting by pressure, welding, and soldering.

Also, a preferable mode is one wherein a portion of each of the at least one fixed contact external connecting terminal mechanically coupled to the at least one fixed contact is exposed from the base.

Also, a preferable mode is one wherein at least one securing body made of a same plate-shaped conductive material as used for the external connecting terminals and mechanically coupled to at least one the fixed contact is provided in the base.

Also, a preferable mode is one wherein the at least one securing body is molded by a press with part of the at least one securing body being coupled to the group of external connecting terminals and a portion coupled between the at least one securing body and each one of the group of external connecting terminals is removed after the group of external connecting terminals is insert-molded into the base and the at least one securing body and the group of external connecting terminals are in an electrically isolated state.

Furthermore, a preferable mode is one wherein a portion of the at least one securing body mechanically coupled to the at least one fixed contact and the coupled portion are exposed from the base.

Still another preferable mode is one wherein the at least one fixed contact includes an ordinarily closed fixed contact or an ordinarily opened fixed contact.

In addition, a preferable mode is one that wherein includes at least one pair of the fixed contacts which includes an ordinarily closed fixed contact and an ordinarily opened fixed contact.

According to a second aspect of the present invention, there is provided an electromagnetic relay including:

an electromagnetic block including a core, a coil, a yoke, an armature, and a movable spring having at least one movable contact mechanically coupled to the armature;

at least one fixed contact associated with the at least one movable contact;

a group of external connecting terminals including at least one movable contact external connecting terminal, at least one fixed contact external connecting terminal, and at least one coil external connecting terminal being electrically connected respectively to the at least one movable contact, the at least one fixed contact, and the coil;

a base on which the electromagnetic block, the at least one fixed contact, the group of external connecting terminals are mounted and secured; and an armored cover, wherein the movable spring, the armature, and the yoke make up part of a current-carrying path;

wherein the group of external connecting terminals is formed from a plate-shaped conductive material by cutting and bending and part of each of the external connecting terminals is insert-molded into the base using an electrically insulating material including a resin or ceramic;

wherein the at least one movable contact external connecting terminal is exposed from the base so as to come into direct contact with part of the yoke and the contacted portion of the at least one movable contact external connecting terminal is mechanically coupled and secured to part of the yoke; and wherein at least one the fixed contact is mechanically coupled to the at least one fixed contact external connecting terminal.

With the above configuration, the movable contact external connecting terminals are exposed from the base so as to be in direct contact with the yoke extended portion serving as part of the yoke and the movable contact external connecting terminals and the yoke are mechanically coupled to each other by performing a caulking process or welding process on a surface in which the movable contact external connecting terminals and the yoke are in direct contact with one another and, therefore, heat generated in the coil and in the current-carrying path passing from the movable contacts through the movable spring and the yoke can be effectively transferred to the external connecting terminals and to the electrically insulating material portion of the base.

With another configuration as above, the group of the external connecting terminals are formed from at least one piece of the plate-shaped conductive material by a cutting and bending process, thereby achieving the ease of handling materials and members. In fabricating the group of external connecting terminals and fixed contacts, it makes automation of their fabrication easier to use the plate-shaped conductive material shaped like a reel or like a short strip.

With still another configuration as above, since the fixed contacts are mechanically coupled to the fixed contact external connecting terminals in the base not by cutting and erecting the fixed contacts from one piece of a plate-shaped conductive material but by using another material and members, a volume and area of each of the group of external connecting terminals to be inserted into the base can be made larger and, therefore, heat generated by the group of external connecting terminals can be easily transferred to the entire base and can be effectively dissipated from the base, thus enabling the suppression of the rise in temperatures in the electromagnetic relay.

With still another configuration as above, only by securing a place for mechanical coupling of the fixed contact, comparatively free designing of an arrangement of each external connecting terminal is allowed.

With still another configuration as above, when a securing body for securing the fixed contacts which is made up of the same material as used for the external connecting terminals is provided in the base, the fixed contacts can be secured firmly to the base and, due to assembly among the metal materials, production of an abrasion powder from mold materials can be suppressed at time of the assembly.

With still another configuration as above, when the securing body is molded by a press using the same material as used for the group of external connecting terminals in a state in which the securing body is partially coupled to the group of external connecting terminals, by removing the coupled portion after molding the base, the ease of attaching the securing body to a mold and holding the securing body can be achieved at time of insert molding.

PREFACE FOR THE INVENTION

As described above in the description of the related art, in the conventional electromagnetic relay that carries a current of several tens of amperes for control of a motor, a solenoid, or a like, a rise in temperatures occurs due to heat generated at a contact making up a current-carrying path, terminal, movable spring, or a like and due to heat transferred from the coil. In recent years, there appears a problem that, due to contradictory demands for miniaturization of a relay and for high-capacity (large current) operations of this kind of the relay, a rise in temperatures within the relay is inevitable which, as a result, causes operating failures. Therefore, the suppression in the rise in temperatures in the relay is required.

To achieve this, it is necessary that heat generated within the relay is guided to the outside of the relay to dissipate heat therefrom. The inventors of the present invention have conceived an electromagnetic relay having a configuration to solve this problem.

A prototype of the electromagnetic relay conceived and built by the inventors includes a core, a coil, a yoke, an armature, an electromagnetic block made up of a movable spring having movable contacts mechanically coupled to the armature, a pair of fixed contacts being in contact with the movable contacts, a group of external connecting terminals made up of a movable contact external connecting terminal, fixed contact external connecting terminal, coil external connecting terminal each being electrically connected respectively to the movable contacts, the pair of fixed contacts, and the coil, a base on which the electromagnetic block, the pair of fixed contacts, and the group of external connecting terminals are mounted and secured, and an armored cover, in which the movable spring, armature, and yoke make up part of a current-carrying path and the group of the external connecting terminals are fabricated from one piece of a plate-shaped conductive material by a cutting and bending process and part of each of the external connecting terminals is insert-molded into the base by using an electrically insulating material such as a resin or ceramic and the pair of fixed contacts is formed in a manner in which part of each of the external connecting terminals is cut and erected in a direction vertical to the base and the movable contact external connecting terminals are exposed from the base so as to be in direct contact with part of the yoke and its contacted portion is mechanically coupled and secured to the yoke.

In the disclosed electromagnetic relay, since the insert-molding is performed on the group of external connecting terminals, a contact area between each of the external connecting terminals and the electrically insulating material is large and excellent contact between each of the external connecting terminals and the electrically insulating material is obtained and, therefore, heat of the group of the external connecting terminals is easily transferred to the entire base, which enables heat to be dissipated from the entire base and, as a result, the rise in temperatures within the electromagnetic relay is suppressed. Moreover, the group of the external connecting terminals and fixed contacts are formed from at least one piece of a plate-shaped conductive material by a cutting and bending process, which achieves the ease of handling materials and members.

However, in the electromagnetic relay, since the fixed contacts, as in the case of the external connecting terminals, are formed from at least one piece of the plate-shaped conductive material by cutting and bending, pattern designing of the plate-shaped conductive material becomes difficult in some cases. For example, in some cases, it is made difficult to secure space required to cut and erect the fixed contacts to realize a desired arrangement of the connecting terminals. Moreover, in some cases, even when the fixed contacts can be cut and erected from the plate-shaped conductive material, each of the group of the external connecting terminals to be wrapped by the insulating materials on the base becomes small in volume depending on arrangements of the terminals, thus decreasing the effect of dissipating heat from an entire surface of the base.

In view of the above, it is another object of the present invention to provide an electromagnetic relay which allows more free designing of an arrangement of each external connecting terminal when compared with the prototype as above.

BRIEF DESCRIPTION OF THE DRAWINGS

The above and other objects, advantages, and features of the present invention will be more apparent from the following description taken in conjunction with the accompanying drawings in which.

DETAILED DESCRIPTION OF THE PREFERRED EMBODIMENTS

Best modes of carrying out the present invention will be described in further detail using various embodiments with reference to the accompanying drawings.

First Embodiment

Figure 1:
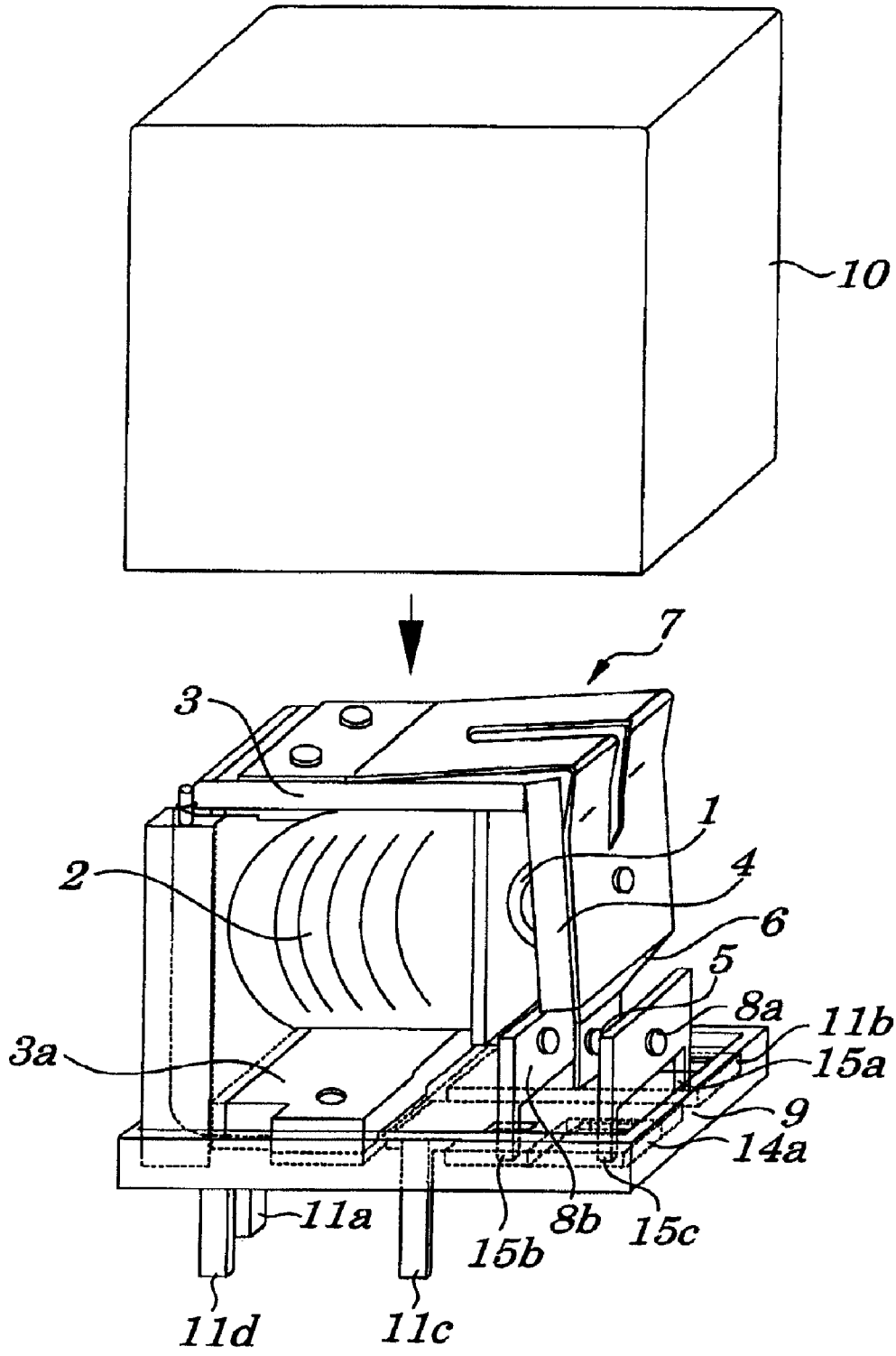
FIG. 1 is a perspective view of an electromagnetic relay according to a first embodiment of the present invention.

FIG. 1 is a perspective view of an electromagnetic relay according to a first embodiment of the present invention. As shown in FIG. 1, the electromagnetic relay includes a core 1, a coil 2, a yoke 3, an armature 4, an electromagnetic block 7 made up of a movable spring 6 having a movable contact 5 mechanically coupled to the armature 4, a pair of fixed contacts made up of an ordinarily closed fixed contact 8*a* and an ordinarily opened fixed contact 8*b* both being contact with the movable contact 5 in a manner in which both the fixed contacts 8*a* and 8*b* strike the movable contact 5 to come into physical contact, a group of external connecting terminals made up of a movable contact external connecting terminal 11*a* electrically connected to the movable contact 5, an ordinarily closed fixed contact external connecting terminal 11*b* electrically connected to the ordinarily closed fixed contact 8*a*, an ordinarily opened fixed contact external connecting terminal 11*c* electrically connected to the ordinarily opened fixed contact 8*b*, and a pair of coil external connecting terminals 11*d* and 11*d*, a base 9 on which the electromagnetic block 7, the pair of fixed contacts, group of the external connecting terminals 11*a*, 11*b*, 11*c*, 11*d* and 11*d* are mounted and secured, and an armored cover 10.

The movable spring 6, the armature 4, and the yoke 3 make up part of a current-carrying path and an upper surface of a yoke extended portion 3*a* making up part of the yoke 3 is in direct contact with the movable contact external connecting terminal 11*a* and is mechanically coupled to the terminal 11*a* by a caulking method via a caulking hole 13 (not shown in FIG. 1). The ordinarily closed fixed contact 8*a* is coupled electrically and thermally to the ordinarily closed fixed contact external connecting terminal 11*b* by a mechanical coupling portion 15*a* and is also mechanically connected to a securing body 14*a* for firm positional fixing. The above coupling is achieved by inserting a coupling portion of each of the fixed contacts 8*a* and 8*b* by pressure or by securing portions to be coupled using welding, soldering, or a like. Similarly, the ordinarily opened fixed contact 8*b* is coupled to the ordinarily opened fixed contact terminal connecting terminal 11*c* and is also mechanically connected to a securing body 14*b* (not shown) for firm positional fixing.

Figure 2:
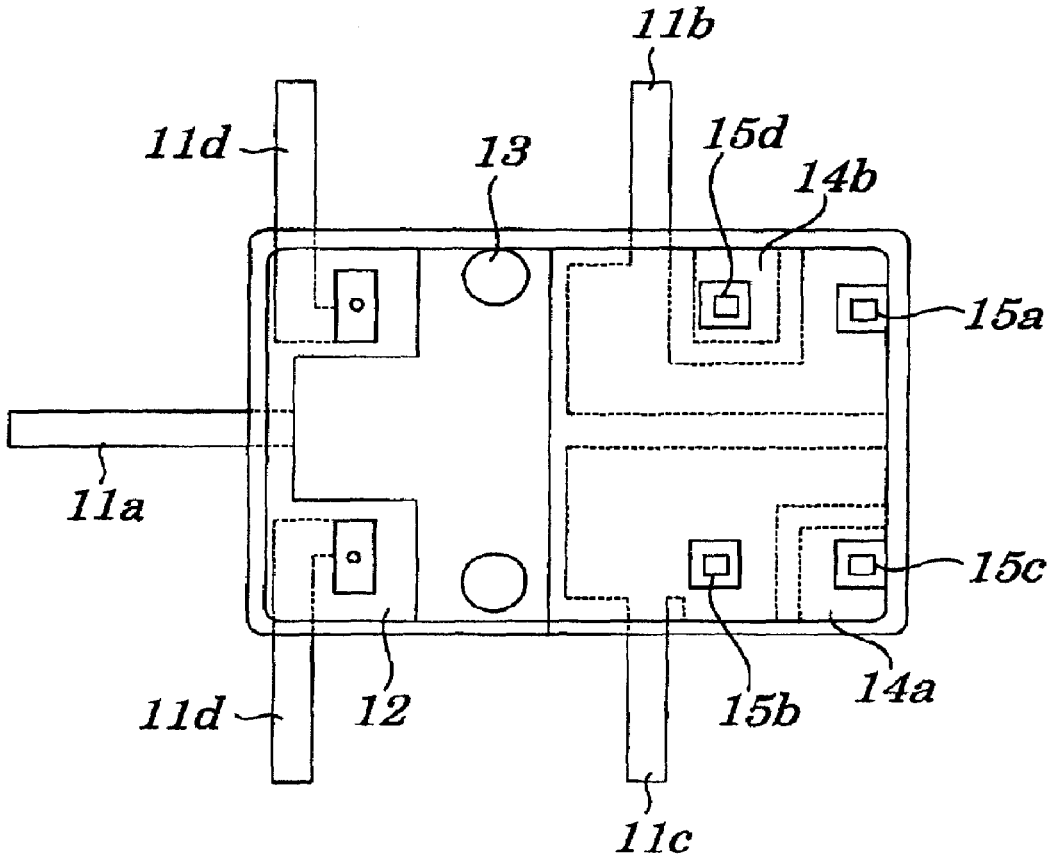
FIG. 2 is a plan view showing configurations of a base and a group of external connecting terminals according to the first embodiment.

FIG. 2 is a plan view showing configurations of the base 9 and the group of the external connecting terminals 11*a*, 11*b*, 11*c*, 11*d* and 11*d*, showing a state in which each of the external connecting terminals 11*a*, 11*b*, 11*c*, 11*d* and 11*d* and each of the securing bodies 14*a* and 14*b* are cut and separated from one piece of a metal plate made of copper metal or a like. The external connecting terminals 11*a*, 11*b*, 11*c*, 11*d* and 11*d* and securing bodies 14*a* and 14*b* are secured to the base 9 by an insert-molding method using an electrical insulating material 12 such as a heat-resistant resin, ceramic, or a like.

The ordinarily closed fixed contact external connecting terminal 11*b* and the ordinarily opened fixed contact external connecting terminal 11*c* have, respectively, mechanical coupling portions 15*a* and 15*b* used to mechanically couple the fixed contacts 8*a* and 8*b*, which are exposed from an upper surface of the base 9, thereby achieving the ease of mechanical coupling. Also, the securing body 14*a* for the ordinarily closed fixed contact 8*a* and the securing body 14*b* for the ordinarily opened fixed contact 8*b* have, respectively, mechanical coupling portions 15*c* and 15*d* used to mechanically couple the fixed contacts 8*a* and 8*b* which are exposed from the base 9.

According to the present invention, the coupling and securing between the yoke extended portion 3*a* and the movable contact external connecting terminal 11*a* are made possible not only by the method of caulking but also by the method of welding, soldering, or a like. Also, both the mechanical coupling between each of the fixed contacts 8*a* and 8*b* and each of the external connecting terminals 11*a*, 11*b*, 11*c*, 11*d* and 11*d* and the coupling between each of the fixed contacts 8*a* and 8*b* and each of the securing bodies 14*a* and 14*b* are made possible by the method using pressure, the method of welding such as laser welding, arc welding, and resistance welding and by the method of soldering.

A tip portion serving as a portion in which each of the external connecting terminals 11*a*, 11*b*, 11*c*, 11*d* and 11*d* shown in FIG. 1 is connected to the printed circuit board is formed in a state in which the tip portion is bent almost vertically to the base 9 when compared with the state shown in FIG. 2, however, a shape of each tip portion may be of various types used in conventional methods depending on each case of mounting on printed circuit boards.

Second Embodiment

The configurations of the electromagnetic relay of the second embodiment differ from those in the first embodiment only in the method of fabricating securing bodies 14*a* and 14*b*.

Figure 3:
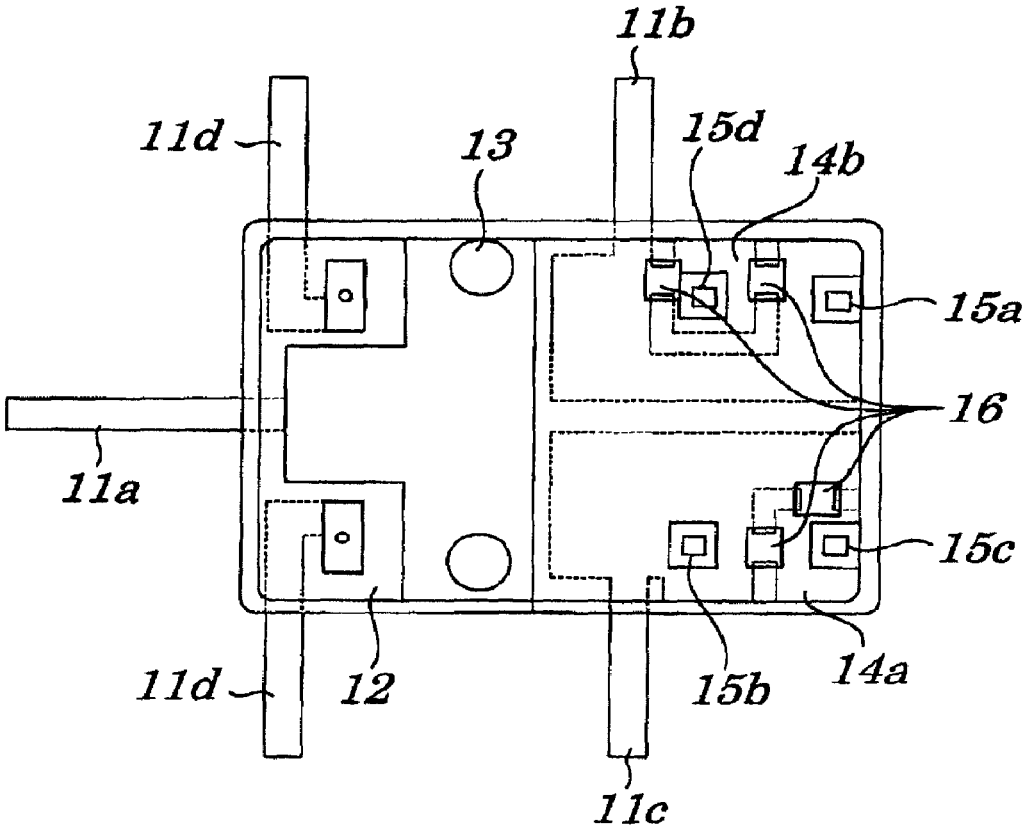
FIG. 3 is a plan view showing configurations of a base and a group of external connecting terminals to be used in the second embodiment.

FIG. 3 is a plan view showing configurations of a base and a group of external connecting terminals to be used in the second embodiment. As in the case of FIG. 2, FIG. 3 shows a state in which each external connecting terminal and each securing body are cut and separated from one piece of a metal plate.

However, as shown in FIG. 3, the securing bodies 14*a* and 14*b* and the ordinarily opened fixed contact external connecting terminal 11*c* and ordinarily closed fixed contact external connecting terminal 11*b* are molded by a press in a state in which each of the securing bodies 14*a* and 14*b* is partially coupled to each of the external connecting terminals 11*c* and 11*b* and then the insert-molding is carried out. Each of coupling portions 16 is exposed from an upper surface of a base 9 and is removed before a pair of fixed contacts and an electromagnetic block are mounted and secured on the base 9. The method of removing the coupling portions 16 includes a method of stamping the coupling portions 16 by a press and of cutting the coupling portions 16 by using a laser. According to the present invention, when the external connecting terminals 11*b* and 11*c* and the securing bodies 14*a* and 14*b* are insert-molded into the base 9, single holding of each of the securing bodies 14*a* and 14*b* is not required, thereby achieving the ease of handling.

It is apparent that the present invention is not limited to the above embodiments but may be changed and modified without departing from the scope and spirit of the invention. For example, shapes, arrangements, numbers, and a like of the electromagnetic block, the pair of the fixed contacts, the movable contacts, the external connecting terminals can be freely designed depending on use.

That is, the electromagnetic relay according to the present invention may include not only one pair but also two or more pairs of the fixed contacts, each pair of which includes an ordinarily closed fixed contact and an ordinarily opened fixed contact.

In addition, one or more fixed contacts are configured as only an ordinarily closed fixed contact configuration, or only an ordinarily opened fixed contact configuration, instead of a pair fixed contact configuration.

The present invention can be applied mainly to automotive electrical devices which require driving control of a current as large as several tens of amperes such as motors, solenoids, and a like and can be applied also to industrial apparatuses, household electrical appliances, and a like.

What is claimed is:

1. An electromagnetic relay comprising:

an electromagnetic block comprising a core, a coil, a yoke, an armature, and a movable spring having at least one movable contact mechanically coupled to said armature, said movable spring, said armature, and said yoke make up part of a current-carrying path;

at least one fixed contact associated with said at least one movable contact;

a group of external connecting terminals formed from a plate-shaped conductive material and comprising at least one movable contact external connecting terminal, at least one fixed contact external connecting terminal, and at least one coil external connecting terminal being electrically connected respectively to said at least one movable contact, said at least one fixed contact, and said coil, at least one said fixed contact being mechanically and thermally coupled to said at least one fixed contact external connecting terminal;

a base on which said electromagnetic block, said at least one fixed contact, said group of external connecting terminals are mounted and secured, part of each of said external connecting terminals being insert-molded into said base using an electrically insulating material, said at least one movable contact externally connecting terminal being exposed from said base so as to come into contact with part of said yoke and a contacted portion of said at least one movable contact external connecting terminal being mechanically coupled and secured to part of said yoke; and an armored cover.

2. The electromagnetic relay according to claim 1, wherein said group of external connecting terminals is formed from at least one piece of said plate-shaped conductive material by cutting and bending.

3. The electromagnetic relay according to claim 1, wherein said electrically insulating material comprises a resin or ceramic.

4. The electromagnetic relay according to claim 1, wherein said at least one movable contact external connecting terminal is exposed from said base so as to come into direct mechanically contact with part of said yoke.

5. The electromagnetic relay according to claim 1, wherein said at least one fixed contact is mechanically coupled to said at least one fixed contact external connecting terminal by at least one of methods of fitting by pressure, welding, and soldering.

6. The electromagnetic relay according to claim 1, wherein a portion of each of said at least one fixed contact external connecting terminal mechanically coupled to said at least one fixed contact is exposed from said base.

7. The electromagnetic relay according to claim 1, wherein at least one securing body made of a same plate-shaped conductive material as used for said external connecting terminals and to structurally supporting and securing at least one said fixed contact is provided in said base.

8. The electromagnetic relay according to claim 7, wherein said at least one securing body is molded by a press with part of said at least one securing body being coupled to said group of external connecting terminals and a portion coupled between said at least one securing body and each one of said group of external connecting terminals is removed after said group of external connecting terminals is insertmolded into said base and said at least one securing body and said group of external connecting terminals are in an electrically isolated state.

9. The electromagnetic relay according to claim 8, wherein a portion of said at least one securing body mechanically coupled to said at least one fixed contact and the coupled portion are exposed from said base.

10. The electromagnetic relay according to claim 1, wherein said at least one fixed contact comprises an ordinarily closed fixed contact or an ordinarily opened fixed contact.

11. The electromagnetic relay according to claim 1, comprising at least one pair of said fixed contacts which comprises an ordinarily closed fixed contact and an ordinarily opened fixed contact.

12. An electromagnetic relay comprising:

an electromagnetic block comprising a core, a coil, a yoke, an armature, and a movable spring having at least one movable contact mechanically coupled to said armature, said movable spring, said armature, and said yoke make up part of a current-carrying path;

at least one fixed contact associated with said at least one movable contact;

a group of external connecting terminals formed from a plate-shaped conductive material and comprising at least one movable contact external connecting terminal, at least one fixed contact external connecting terminal, and at least one coil external connecting terminal being electrically connected respectively to said at least one movable contact, said at least one fixed contact, and said coil, at least one said fixed contact being mechanically and thermally coupled to said at least one fixed contact external connecting terminal;

a base on which said electromagnetic block, said at least one fixed contact, said group of external connecting terminals are mounted and secured, part of each of said external connecting terminals being insert-molded into said base using an electrically insulating material, said at lease one movable contact externally connecting terminal being exposed from said base so as to come into contact with part of said yoke and a contacted portion of said at least one movable contact external connecting terminal being mechanically coupled and secured to part of said yoke; and an armored cover.

13. The electromagnetic relay according to claim 12, wherein said at least one fixed contact is mechanically coupled to said at least one fixed contact external connecting terminal by at least one of methods of fitting by pressure, welding, and soldering.

14. The electromagnetic relay according to claim 12, wherein a portion of said at least one fixed contact external connecting terminal mechanically coupled to said at least one fixed contact is exposed from said base.

15. The electromagnetic relay according to claim 12, wherein at least one securing body made of a same plate-shaped conductive material as used for said external connecting terminals and structurally supporting and securing said at least one said fixed contact is provided in said base.

16. The electromagnetic relay according to claim 15, wherein said securing body is molded by a press with part of said securing body being coupled to said group of external connecting terminals and a portion coupled between said securing body and each one of said group of external connecting terminals is removed after said group of external connecting terminals is insertmolded into said base and said securing body and said group of external connecting terminals are in an electrically isolated state.

17. The electromagnetic relay according to claim 16, wherein a portion of said securing body mechanically coupled to said at least one fixed contact and the coupled portion are exposed from said base.

* * * * *